US006641420B2

(12) United States Patent
Blanchfield et al.

(10) Patent No.: US 6,641,420 B2
(45) Date of Patent: Nov. 4, 2003

(54) FLOATABLE CONNECTOR ASSEMBLY WITH A STAGGERED OVERLAPPING CONTACT PATTERN

(75) Inventors: Michael Allen Blanchfield, Camp Hill, PA (US); John Bossert Brown, III, Dillsburg, PA (US); Troy Everette Conner, York, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/246,090

(22) Filed: Sep. 18, 2002

(65) Prior Publication Data

US 2003/0017747 A1 Jan. 23, 2003

Related U.S. Application Data

(62) Division of application No. 09/871,048, filed on May 31, 2001.

(51) Int. Cl.[7] ..... H01R 13/64; H01R 13/73

(52) U.S. Cl. ..... 439/247; 439/248; 439/545

(58) Field of Search ..... 439/247, 248, 439/692, 590, 342, 682, 660, 689, 686, 545

(56) References Cited

U.S. PATENT DOCUMENTS

| | | | | | |
|---|---|---|---|---|---|
| 4,664,456 | A | * | 5/1987 | Blair et al. | 439/108 |
| 4,761,144 | A | * | 8/1988 | Hunt et al. | 439/545 |
| 4,812,133 | A | * | 3/1989 | Fleak et al. | 439/248 |
| 4,846,737 | A | | 7/1989 | Jorroch et al. | 439/752 |
| 5,518,426 | A | | 5/1996 | Plainer | 439/682 |
| 5,575,673 | A | * | 11/1996 | Dahlem et al. | 439/248 |
| 5,620,329 | A | * | 4/1997 | Kidd et al. | 439/248 |
| 5,855,493 | A | | 1/1999 | Shelly | 439/465 |
| 6,017,233 | A | * | 1/2000 | Fry et al. | 439/248 |
| 6,174,185 | B1 | * | 1/2001 | Cecil, Jr. | 439/248 |
| 6,176,738 | B1 | * | 1/2001 | Consoli et al. | 439/545 |
| 6,196,856 | B1 | * | 3/2001 | De Villeroche | 439/248 |
| 6,217,358 | B1 | * | 4/2001 | Norizuki et al. | 439/247 |
| 6,361,379 | B1 | | 3/2002 | Ito et al. | 439/752 |
| 6,435,890 | B2 | * | 8/2002 | Kato et al. | 439/247 |

* cited by examiner

*Primary Examiner*—Lynn Feild
*Assistant Examiner*—Michael C. Zarroli

(57) ABSTRACT

A connector assembly is provided with a floatable mounting apparatus formed thereon to enable the connector assembly to correct for misalignment between mounting structures. The connector assembly includes a connector housing having peripheral surfaces with an outer contour shaped to loosely fit in an inner contour of a mounting structure, such as a card, panel, circuit board, bulk head, rack assembly and the like. The connector housing is slidably inserted into the opening through the mounting structure. A chamber is provided in the connector housing adapted to securely retain contacts. At least one latch beam is formed with the connector housing and aligned to engage the mounting structure. A float gap is located between the inner contour of the opening through the mounting structure and the outer contour of the connector housing to enable relative movement therebetween. Guide pins are provided on a receptacle connector and guide pockets are provided on a plug connector to facilitate alignment therebetween during a mating operation. At least one of the receptacle and plug connectors are provided with a pattern of contact receiving cavities therein, in which the cavities are formed in staggered overlapping rows to afford a compact connector envelope while enabling large blades and large wire gauges to be used.

17 Claims, 9 Drawing Sheets

FLOATABLE CONNECTOR ASSEMBLY WITH A STAGGERED OVERLAPPING CONTACT PATTERN

RELATED APPLICATIONS

The present application is a divisional of application Ser. No. 09/871,048, filed May 31, 2001, which is incorporated herein in it entirety by reference.

BACKGROUND OF THE INVENTION

Embodiments of the present invention generally relate to electrical connector assemblies. At least one embodiment generally relates to a floating connector assembly movably mounted to a support structure permitting connection even when the supporting structure are misaligned. At least one embodiment of the present invention generally relates to a staggered contact pattern to afford a compact connector envelope while maintaining large contacts and wire gauge.

Today, connector assemblies are utilized in a variety of applications and fields. Exemplary fields including, but are not limited to, telecommunications, internet applications, personal computers and the like. Exemplary applications include, but are not limited to, connecting components, boards and cards in computers, servers, networks and the like. One exemplary style of connection involves interconnecting rack and panel assemblies, also referred to as "drawer connectors."

Often, connector assemblies are utilized with a plug connector mateable with a receptacle connector, each of which is mounted to some form of support structure. By way example only, one of the plug or receptacle connectors may be mounted to a subassembly, component, card, panel or circuit board, while the other connector may be mounted to a bulkhead or rack assembly that holds the card, panel, board, component or subassembly. Alternatively, the plug and receptacle connector halves may both be mounted to panels, cards or circuit boards. As a further exemplary alternative, one connector half may be provided on a rack, while the other connector half may be provided on a panel. The rack assembly may have slots or carriages that receive panels, cards or boards carrying signal and/or power components. The slots or carriages may loosely receive the panel, card or board and not necessarily guide a panel, board or card in a close tolerance along a slot or carriage path. The loose tolerance within the slot or carriage permits the board, card or panel to move slightly in the lateral and vertical directions transverse to the length of the slot or carriage path. The panels, cards and boards may also become slightly turned when loaded into the slot or carriage. Consequently, when panels, cards or boards are slid into a rack assembly, the connector on the panel, card or board may not precisely aligned with the mating connector on the rack assembly.

Heretofore, misalignment has been addressed by mounting the connector assemblies to the rack assembly via an intermediary separate mounting apparatus. The mounting apparatus permits the connector mounted on the rack assembly to move relative to the rack assembly within a limited tolerance. The limited motion offered between the rack assembly and a connector thereon may also be referred to as "float". The connector mounted to the rack assembly may be a plug, a receptacle or any other type of connector component. The connector mounted to the panel, card or board is directly, fixedly and rigidly secured in a non-floating arrangement. The rigid connection of the connector to a panel, card or board is simply referred to as "board mounted".

However, conventional mounting apparatus that permit float between a connector and a rack assembly require additional hardware, in addition to, and separate and apart from, the connector housing. For instance, the mounting apparatus may include one or more brackets with oversized holes provided therein. Nuts and bolts or screws secure the bracket to the connector and to the rack assembly. The holes through the bracket are larger than the bolts or screws to permit movement therebetween, thereby affording float. In addition, conventional mounting apparatus often utilize springs to bias the connector to one extreme position along a float range, while still permitting the connector to move. The additional hardware of the brackets, springs, nuts, bolts and screws in rack and panel or drawer connections is disadvantageous.

Moreover, the power and signal requirements of connector assemblies continue to grow more demanding, as does the requirement for smaller and more compactly designed contact layouts. Conventional connectors that utilize multiple contacts typically arrange the contacts in a pattern, in which the contacts are aligned next to one another with a set, uniform amount of insulated housing material provided between adjacent contacts. Exemplary patterns include contacts arranged in rows and columns. The contacts in each row are provided in cavities that are separated by the insulated housing material of a desired thickness. The contact cavities in each column are also separated by insulated housing material of a desired thickness.

In conventional contact pattern layouts, the overall envelope of the connector assembly is defined in part by the number of cavities, the dimensions of each cavity, and the number and size of the gaps between cavities in each row and column. For example, the width of a conventional contact envelope is at least equal to the width of each cavity times the number of cavities in one row plus the width of each insulated space between cavities times the number of spaces between the cavities. Similarly, the height of a conventional contact envelope is at least equal to the cavity height times the number of cavities in a column plus the thickness of the spaces between cavities in a column times the number of spaces in a column. The contact size in part determines the height and width of the cavities, as well as determining the size or gauge of wire connectable thereto.

In the past, in order to reduce the size of the connector envelope, it was necessary to use smaller contacts and smaller gauge wire. The contact size and wire gauge limit the power delivery capability of the connector. Hence, in high-power applications, it is desirable to maintain the contact and wire size as large as possible. It is also preferable to provide contact layouts that have high heat dissipation properties, such as for use in high current applications.

In addition, past connector designs have attempted to minimize the connector envelope by using multiple contact shapes and configurations within a single connector housing. However, it was necessary to develop separate tooling for each contact shape and configuration.

A connector assembly is needed that affords self-alignment between the receptacle and plug when the support structures are mis-aligned, without requiring separate connector mounting apparatus. A contact pattern is needed that is compact, yet is able to afford larger contacts connectable to a large gauge wire, thereby affording high power capacity and beneficial heat dissipating qualities. A connector design is also needed that affords symmetric mating areas that allow one contact design to be used to populate all positions in the connector housing.

The goals and objectives of at least certain embodiments of the present invention are to satisfy the needs and overcome the problems discussed above, as well as additional problems that will become apparent from the foregoing explanation and following detailed description, claims, abstract and drawings.

BRIEF SUMMARY OF THE INVENTION

A connector assembly is provided that is floatably mounted to a mounting structure. The connector assembly includes a mounting structure having a connector opening therein that includes an inner contour. A connector housing is provided with peripheral surfaces having an outer contour shaped to loosely fit in the inner contour of the mounting structure. The connector housing is slidable inserted into the opening in the mounting structure. A chamber is provided in the connector housing that is adapted to securely retain at least one contact. At least one latch beam is formed with the connector housing. The latch beam engages the opening in the mounting structure and floatably secures the connector housing to the opening in the mounting structure. A float gap is provided between the inner contour of the opening and the outer contour of the connector housing to enable relative movement therebetween.

In accordance with at least one embodiment, the latch beam is formed integral with, and projects outward from at least one peripheral surface of the connector housing. Optionally, a plurality of latch beams may be spaced about the peripheral surfaces of the connector housing. Alternatively, a pair of latch beams may be raised on opposite sides of the connector housing and oriented diagonally opposed from one another.

In accordance with one embodiment, guide pockets are located within and arranged along side the chamber that retains the contacts. The guide pockets are adapted to receive guide pins formed on the mating connector housing. The guide pins and pockets cooperate to ensure proper alignment during connection.

Optionally, the connector housing includes a backside having at least one flange laterally extending outward from one peripheral surface. The flange engages one side of the mounting structure. The latch beam engages an opposite side of the mounting structure. The flange and latch beam retain the connector housing within the mounting structure.

In accordance without another embodiment, a connector assembly is provided having first and second connector housings having first and second mating faces and sidewalls defining outer perimeters thereof. First and second cavities are provided to retain contacts in the first and second connector housings, respectively. The contacts in the first and second connector housings are mateable with one another when joined. A first mounting structure is included with a connector opening having an inner perimeter that accepts the first connector housing. A space is provided between the inner perimeter of the connector housing and the outer perimeter of the first connector housing. The space permits lateral movement between the first connector housing and mounting structure. A latch assembly is formed with the first connector housing to retain the first connector housing in the connector opening while permitting movement between the first connector housing and the mounting structure.

In accordance with one alternative embodiment, the latch assembly includes latch beams formed integral with sidewalls and projecting outward and rearward from the side walls.

In accordance with at least one alternative embodiment, an electrical connector assembly is provided having a connector housing with a mating face and a wire receiving face. A mating cavity is formed in the mating face and a plurality of chambers are provided in the connector housing with each chamber having a front end opening onto the mating face and a rear end opening onto the wire receiving face. A plurality of contacts are provided, in which each contact is secured in one of the chambers. The chambers are arranged in at least two rows with chambers in adjacent rows being staggered with respect to one another. Optionally, the rows are shifted laterally with respect to one another. The distance that the rows are shifted may be approximately half of the width of a chamber.

Optionally, each chamber may include a body section and a notched slot extending along, and projecting outward from, one wall of the main body. The notched slots of the chambers in adjacent rows are directed toward and overlapping one another. Optionally, the chambers in a first row may extend into a space between chambers in a second row that are adjacent to the first row of chambers. The chambers in the first and second rows form a partial, overlapping pattern. Optionally, chambers in an upper row include notched slots extending downward into insulated spacers between chambers in a lower row located immediately below and adjacent the upper row of chambers.

Optionally, a power contact may be provided with a base portion securely retained within a corresponding chamber and a lead portion extending from the base portion into the cavity and a wire retention barrel extending rearward from the base section that is adapted to be securely crimped to a power wire. Optionally, a plurality of contacts may be securely retained in the chambers with each contact including a wire crimping barrel and each contact formed with a substantially similar shape and configuration.

Optionally, contacts may be provided that include wire crimping barrels extending from rear ends thereof. Contacts in a first row of chambers may be oriented, such that the wire crimping barrels are located near the bottom of the contacts and contacts in a second row may be oriented with the wire crimping barrels located toward the top of the contacts.

In accordance with at least one embodiment, an electrical connector system is provided having first and second connectors with first and second mating faces, respectively, mateable with one another. Contact cavities are formed in the first and second connectors and have at least one opening at the first and second mating faces. Contacts are secured in the contact cavities. The contact cavities are arranged with at least one upper and one lower contact cavity. The upper contact cavity contains a contact that is oriented with respect to a housing vertical axis in a first direction, while the lower cavity includes a contact oriented in a second direction with respect to the housing vertical axis that differs from the first direction.

Optionally, the contact secured in the first connector may include blade sections that are oriented in a first direction with the contacts turned upright when mounted in a first set of cavities and oriented in a second direction with the contacts turned downward when provided in a second set of cavities.

BRIEF DESCRIPTION OF SEVERAL VIEWS OF THE DRAWINGS

The foregoing summary, as well as the following detailed description of the preferred embodiments of the invention, will be better understood when read in conjunction with the appended drawings. For the purpose of illustrating the present invention, there is shown in the drawings, embodiments that are presently preferred. It should be understood, however, that the present invention is not limited to the precise arrangements and instrumentality shown in the attached drawings.

Figure 1:
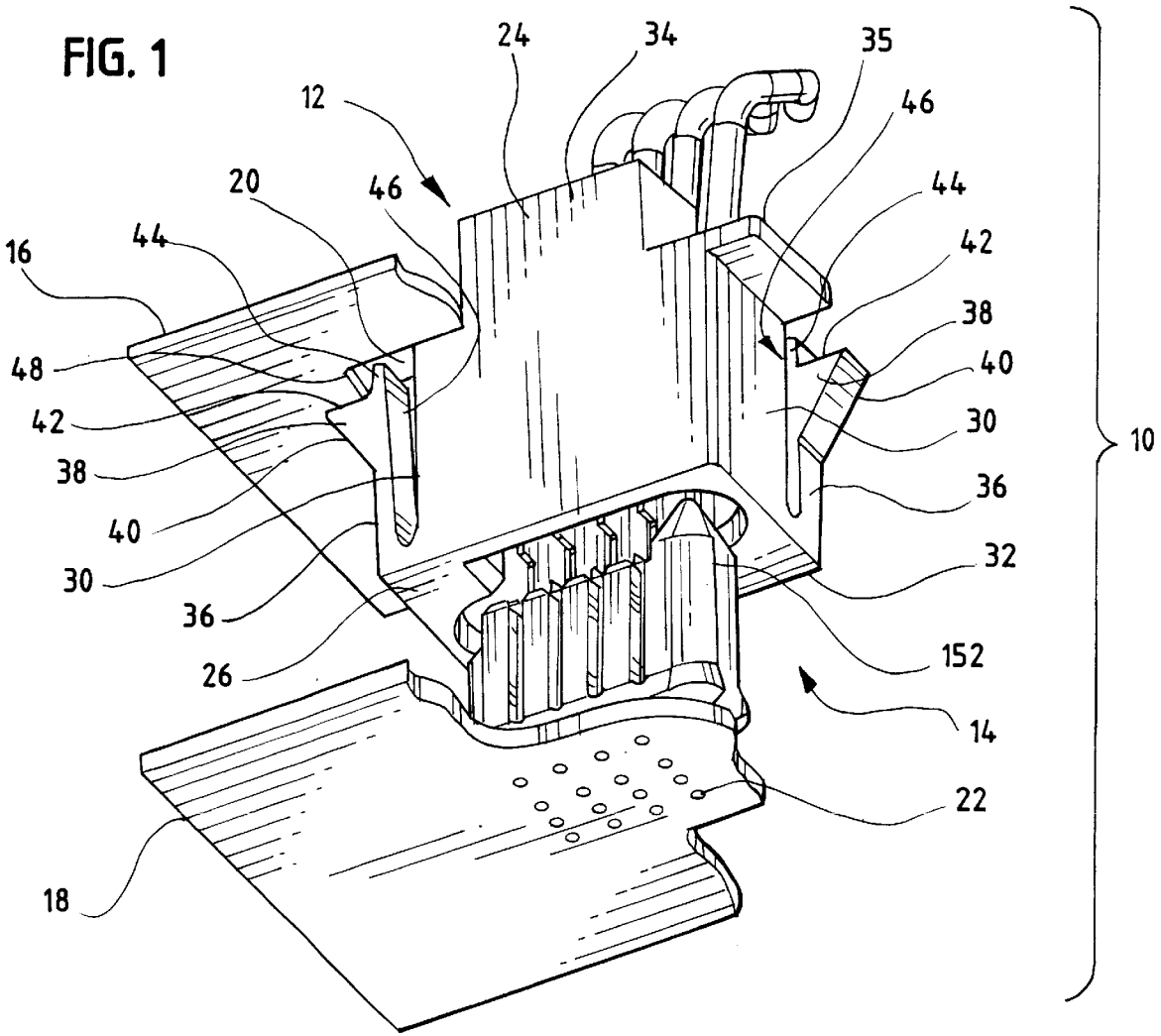
FIG. 1 illustrates an isometric view of a connector assembly formed in accordance with one embodiment of the present invention and connected to first and second mounting structures.

The foregoing summary, as well as the following detailed description of certain embodiments of the present invention, will be better understood when read in conjunction with the appended drawings. For the purpose of illustrating the invention, there is shown in the drawings, certain embodiments. It should be understood, however, that the present invention is not limited to the arrangements and instrumentality shown in the attached drawings.

DETAILED DESCRIPTION OF THE INVENTION

FIG. 1 illustrates an isometric view of a connector assembly 10 formed in accordance with one embodiment of the present invention. The connector assembly 10 includes a plug connector 12 aligned with a receptacle connector 14 in a pre-mated, aligned position. The plug connector 12 is floatably secured to a first support structure 16 (only a cut-away portion of which is shown). The receptacle connector 14 is rigidly secured to a second support structure 18 (only a cut-away portion of which is shown). By way of example only, the first and second support structures 16 and 18 includes, but is not limited to; circuit boards, cards, panels, a rack assembly, drawer connectors and alike. In the example of FIG. 1, the plug connector 12 is snapably engaged in an opening 20 in the first support structure 16, while the receptacle connector 14 is rigidly, securely and directly affixed to the second support structure, such as through soldering to plated through holes 22 and alike.

The plug connector 12 includes a plug housing 24 having a mating face 26, top surface 28, side walls 30, a bottom surface 32 and a rear face 34. The rear face 34 includes lateral flanges 35 extending outward along both sides of the plug connector 12. The flanges 35 engage the backside of the first support structure 16, while permitting vertical and lateral movement therebetween. A pair of latch beams 36 is formed on the plug housing 24. The latch beams 36 include projections 38 formed on outer ends thereof with ramped surfaces 40 provided on leading sides and latching surfaces 42 provided on trailing sides thereof. Outer ends of the latch beams 36 include tab fingers 44 extending in directions substantially parallel to the length of the latch beams 36. The latch beams 36 are provided along the side walls 30 and extend from the mating face 26 rearward toward the rear face 34. The latch beams 36 flare outward from the side walls 30 to define a gap 46 therebetween permitting the latch beams 36 to be deflected inward when the plug connector 12 is snapped into the opening 20 in the first support structure 16.

To install the plug connector 12 on the first support structure 16, the mating face 26 of the plug connector 12 is pushed through the opening 20 in the first support structure 16. The latch beams 36 deflect inward until the perimeter of the opening 20 rides over the ramped surfaces 40. Once the ramped surfaces 40 clear the perimeter of the opening 20, the latch beams 36 return to a normally outward biased position in which the latching surfaces 42 and tab fingers 44 engage the inner perimeter 48 of the opening 20. The inner perimeter 48 of the opening 20 has a shape that substantially follows the shape of the outer contour of the plug housing 24. However, the inner perimeter 48 is larger than the plug housing 24 to provide gaps 47 and 49 (FIG. 2) therebetween. The gaps 47 and 49 between the inner perimeter 48 and plug housing 24 permits the plug connector 12, after being snapped into position, to float within a desired range of motion within, and with respect to, the first support structure 16.

By way of example only, if it is desirable to afford the plug housing 24 0.050" of movement laterally with respect to the first support structure 16, the gap 47 is configured such that opposite side edges of the opening 20 are spaced apart a distance at least 0.050" greater than the width of the plug housing 24. Similarly, if it is desirable to afford the plug housing 24 0.050" of movement vertically with respect to the first support structure 16, the gap 49 is configured such that the top and bottom edges of the opening 20 are spaced apart a distance at least 0.050" greater than the height of the plug housing 24.

During a connector mating operation, the plug connector 12 may experience lateral and/or vertical forces from guide pins 152 on the receptacle connector 14. When experiencing lateral forces, the plug housing permits the plug connector 12 to move laterally within the opening 20. When experiencing vertical forces, the lateral flanges 35, tab fingers 44 and latching surfaces 42 slide vertically along the side edges of the opening 20 to permit the plug connector 12 to move vertically within the opening 20.

In the embodiment of FIG. 1, the latch beams 36 are integral with the plug housing 24, however, the latch beams 36 may be constructed separately and then combined during assembly with the plug housing 24. For example, the latch beams 36 may be formed non-integrally on the plug housing 24 through gluing, lamination, press fitting and the like. Alternatively, the latch beams 36 may be fabricated with a rectangular band shaped to closely fit around the top surface 28, bottom surface 32 and side walls 30 through press-fitting.

Figure 2:
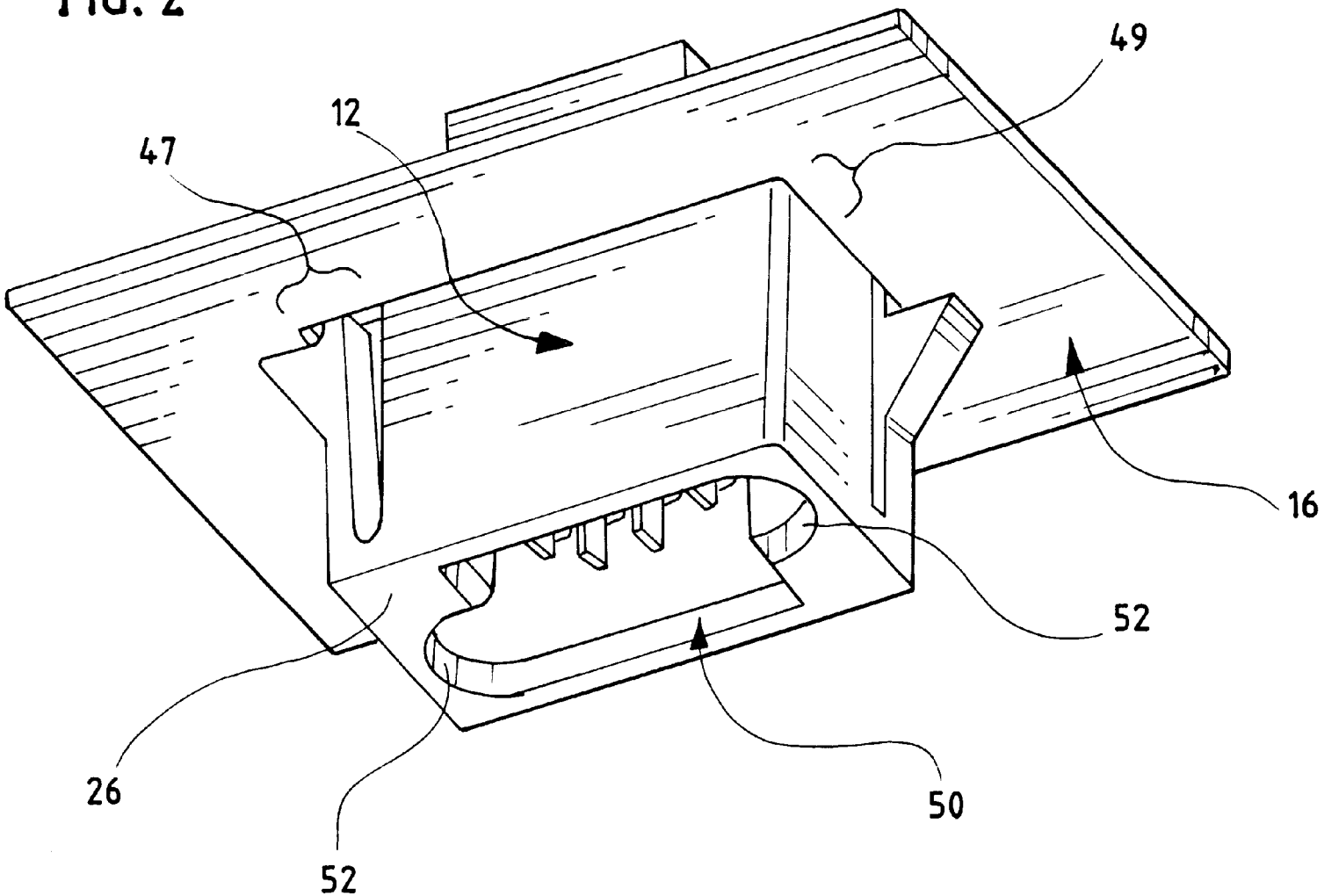
FIG. 2 illustrates an isometric view of a plug connector snapably engaged in a support structure in accordance with at least one embodiment of the present invention.

FIG. 2 illustrates the plug connector 12 as secured within the first support structure 16. The mating face 26 includes a face opening 50 having a contour that substantially follows the outer contour of the receptacle connector 14. The opening 50 may be beveled to facilitate the initial mating operation of the receptacle connector 14. In the embodiment of FIG. 2, the face opening 50 has a main section with a substantially rectangular shape and includes a pair of guide pockets 52 provided on opposite sides of the rectangular main section. The guide pockets 52 are semi-circular in shape and are located diagonally opposed from one another at opposite corners of the main section. Locating the guide pockets 52 in a diagonally opposed manner balances mating forces.

Optionally, a single guide pocket 52 may be provided. Alternatively, more than two guide pockets 52 may be provided. The guide pockets 52 need not be semicircular in shape, but instead may be rectangular, triangular, notched, and alike. Alternatively, the guide pockets 52 may be located on the top and bottom surfaces of the opening 50 or centered on all four sides of the opening 50. As yet a further alternative, the guide pockets 52 need not necessarily be formed as part of the opening 50. Instead, the guide pockets 52 may be formed on the outside of the plug housing 24 such as by providing notched channels along one or more of the top surface 28, sidewalls 30, or bottom surface 32. Alternatively, the guide pockets 52 may be provided as self-contained openings in the mating face 26, separate and apart from the opening 50.

Figure 3:
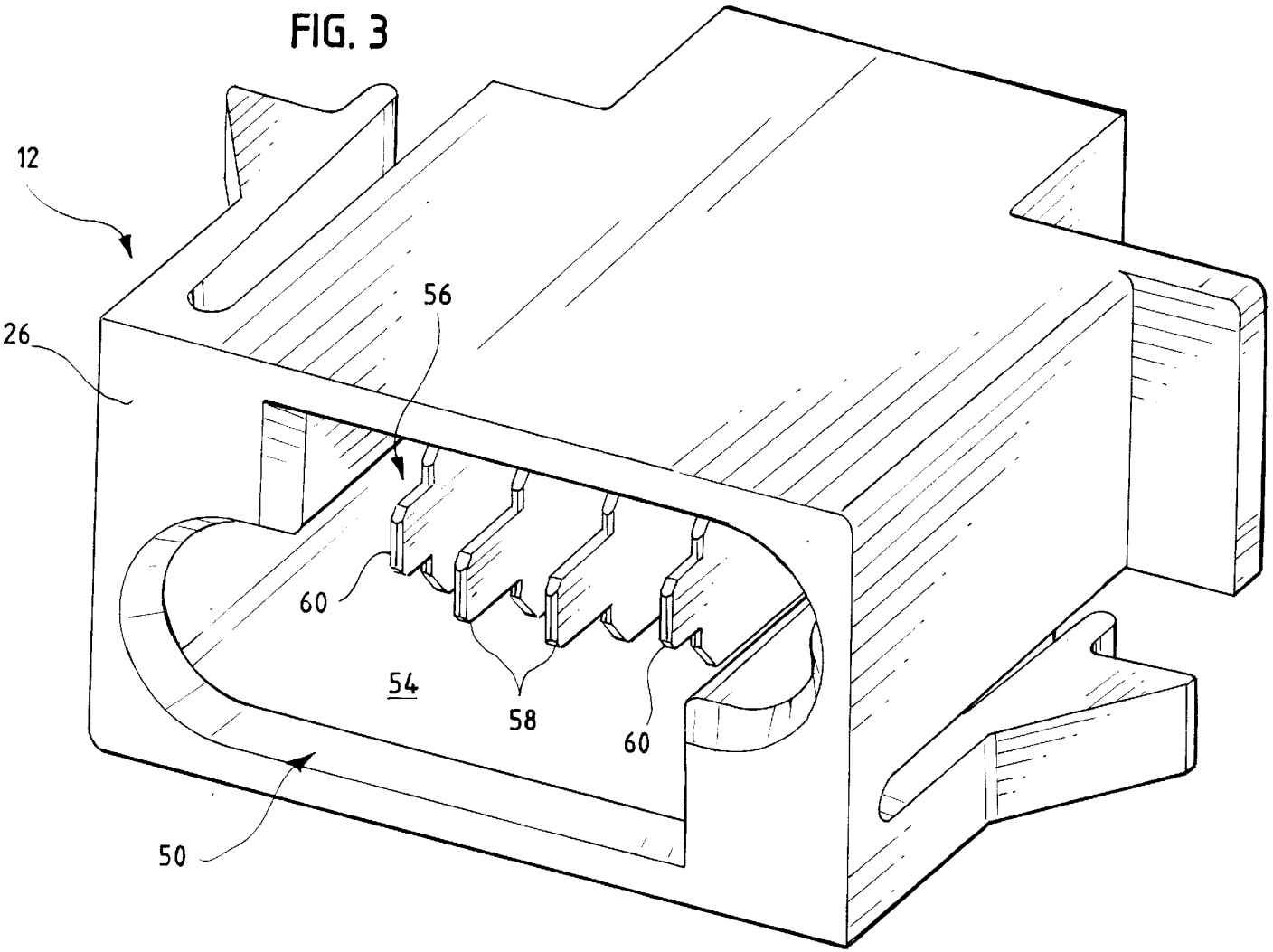
FIG. 3 illustrates a front isometric view of a plug connector formed in accordance with at least one embodiment of the present invention.

FIG. 3 illustrates a front isometric view of the plug connector 12 in accordance with one embodiment. As shown in FIG. 3, the opening 50 expands into a chamber 54 containing lead portions of a plurality of contacts 56 that are securely retained in the connector housing 24. In the embodiment of FIG. 3, the contacts 56 are divided into two groups. A central group of contacts 56 includes nosepieces 58 that are longer than nosepieces 60 on contacts 56 in an outer group. The longer nosepieces 58 are configured to engage mating receptacle contacts before the shorter nosepieces 60 to maintain a make-first-break-last type of connection. Optionally, all of the contacts 56 may have the same length nosepieces or none at all.

Figure 4:
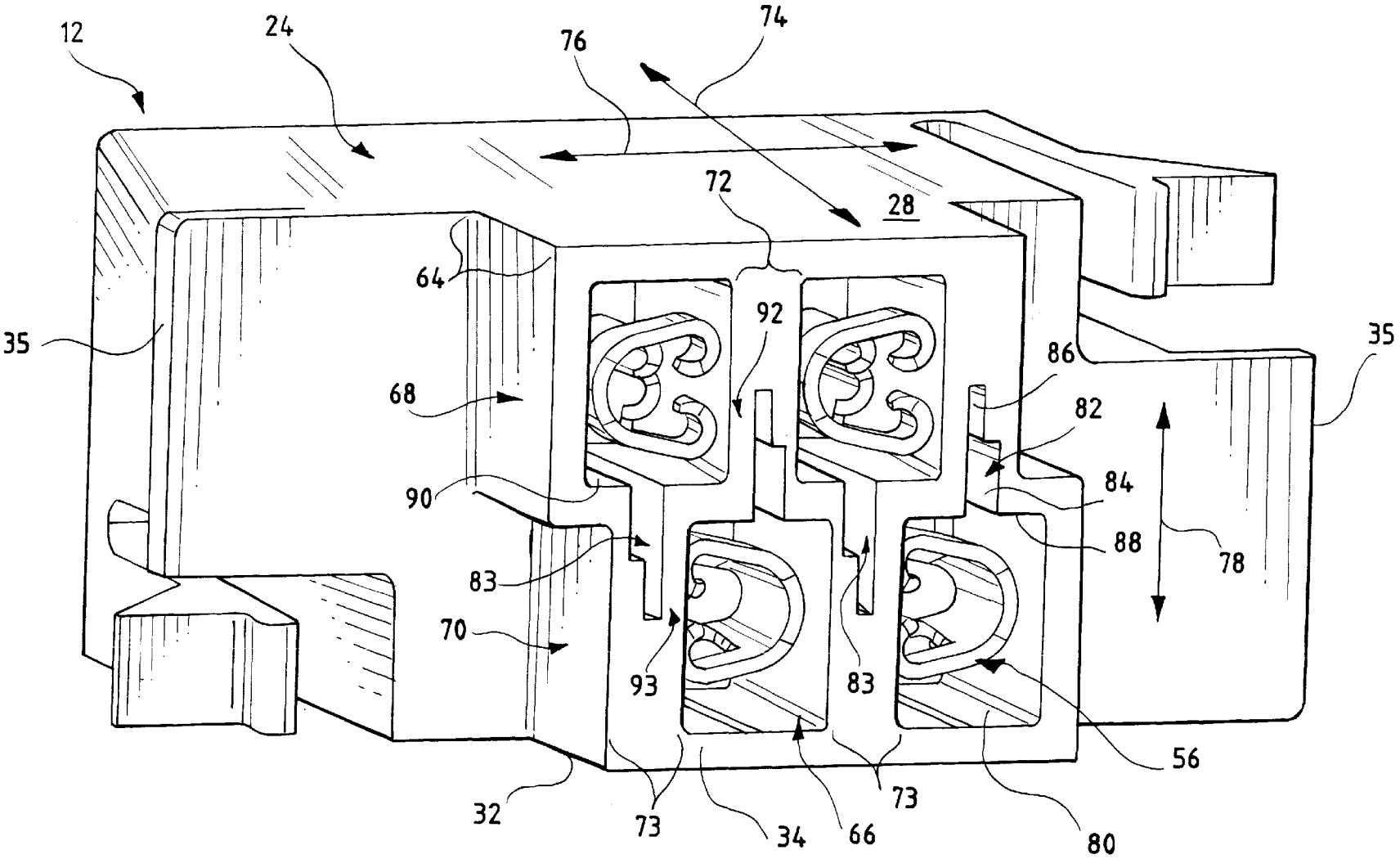
FIG. 4 illustrates a rear isometric view of a plug connector formed in accordance with at least one embodiment of the present invention.

FIG. 4 illustrates a rear isometric view of a plug connector 12 formed in accordance with one embodiment of the present invention. The rear face 34 is provided on a tail section 64 of the plug housing 24. The lateral flanges 35 are located forward of the tail section 64. The lateral flanges 35 are located at a point along the length of the plug housing 24 to position the plug connector 12 with respect to the first support structure 16 at a desired insert depth in order that only a desired portion of the plug connector 12 projects through the opening 20. The plug housing 24 includes a plurality of cavities 66 having rear ends that open onto the rear face 34. The cavities 66 extend forward and include front ends that communicate with the chamber 54.

In the example of FIG. 4, the cavities 66 are arranged in upper and lower rows 68 and 70. The cavities 66 in each of the upper and lower rows 68 and 70 are spaced apart from one another by an insulated cavity spacer 72. The cavities 66 retain contacts 56 that extend in a direction substantially parallel to the longitudinal axis 74 of the plug housing 24. The upper and lower rows 68 and 70 of cavities 66 are aligned in a direction substantially parallel to the lateral axis 76 of the plug housing 24. The contacts 56 are oriented in a plane substantially parallel to a vertical axis 78 of the plug housing 24.

Each cavity 66 includes a main cavity body 80 having a generally rectangular shape and a notch 82 communicating with one side of the cavity body 80. In the example of FIG. 4, the notches 82 are staged stepwise to include a wide notch section 84 and a narrow notch section 86. In the lower row 70 of cavities 66, upper surfaces 88 include the notches 82 therein. In the upper row 68 of cavity 66, the lower surfaces 90 include the notches 83 therein. The notches 82 extend upward into the insulated cavity spacer 72 provided between the cavities 66 in upper row 68. The notches 83, that direct downward from the cavities 66 in the upper row 68, extend into the insulated cavity spacers 72 between the cavities 66.

The cavities 66 in the upper row 68 are staggered with respect to the cavity 66 in the lower row 70 in order to enable the upwardly and downwardly directed notches 82 and 83, respectively, to align with the insulated cavity spacers 72 and 73. By configuring the upper and lower rows 68 and 70 of cavities 66 in a staggered, offset manner, a compact pattern is provided without requiring the overall envelope of the plug housing 24 to be unnecessarily expanded. Insulation layers 92 and 93 are maintained between the notches 82 and 83 and adjacent cavities 66 to ensure proper electrical operation. Optionally, the upper and lower rows 68 and 70 may be shifted in the direction of lateral axis 76 by ½ of the width of a cavity 66 with respect to one another.

Figure 5:
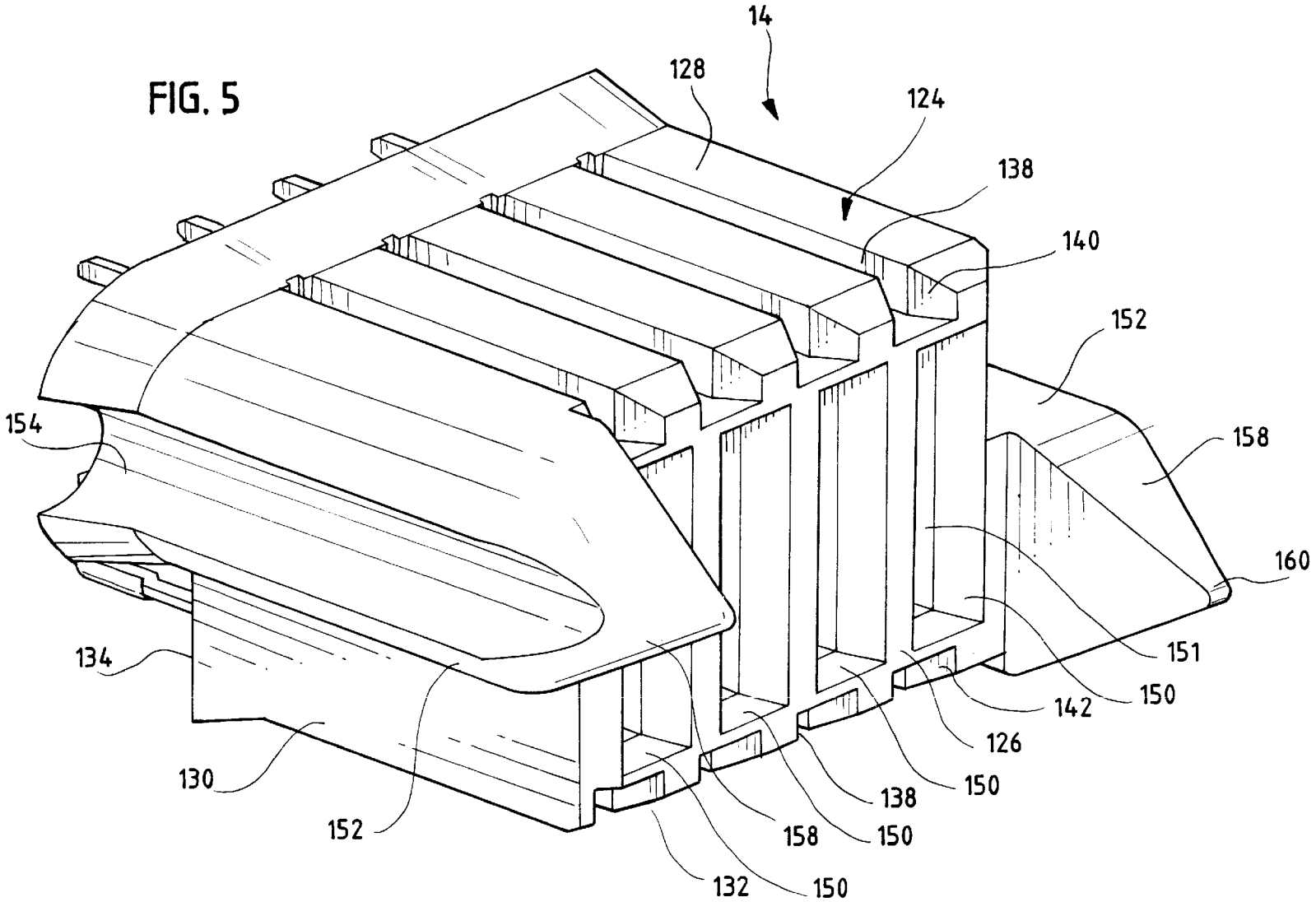
FIG. 5 illustrates a front isometric view of a receptacle connector formed in accordance with at least one embodiment of the present invention.

FIG. 5 illustrates a front isometric view of a receptacle connector 14 formed in accordance with one embodiment of the present invention. The receptacle connector 14 includes a receptacle housing 124 having a mating face 126, top surface 128, side walls 130, a bottom surface 132 and a rear face 134. The rear face 134 is adapted to be rigidly, securely and directly affixed to the second support structure 18 as explained above. Guide pins 152 are formed (integral or otherwise) along opposite side walls 130 and are located diagonally opposed from one another. The guide pins 152 are located on the receptacle housing 124 to align with the guide pockets 52. At least one of the guide pins 152 is formed with a semicircular channel 154 notched in an exterior side thereof. The opposite guide pin 152 includes a hole 156 (FIG. 6) provided therein. The lead ends 158 of the guide pins 152 are tapered to facilitate acceptance of the guide pins 152 into the guide pockets 52 on the plug connector 12 even when misaligned.

During a mating operation, tips 160 on the guide pins 152 enter the guide pockets 52. As the receptacle connector 14 is slid into the opening 50 in the plug connector 12, the tapered surfaces on the lead ends 158 of the guide pins 152 induce biasing forces onto the guide pockets 52, thereby biasing the plug housing 24 laterally and/or vertically to afford proper alignment between the plug and receptacle connectors 12 and 14.

The top and bottom surfaces 128 and 132 on the receptacle housing 124 include notched channels 136 and 138, respectively. The notched channels 136 and 138 have outer beveled ends 140 and 142, respectively. The notched channels 136 and 138 are engaged by a tool used to mount the receptacle housing 124 on the second support structure 18.

The mating face 126 includes a series of openings 150 aligned substantially parallel to one another. The openings 150 communicate with chambers 151 that securely retain receptacle contacts 100 (FIG. 8).

Figure 6:
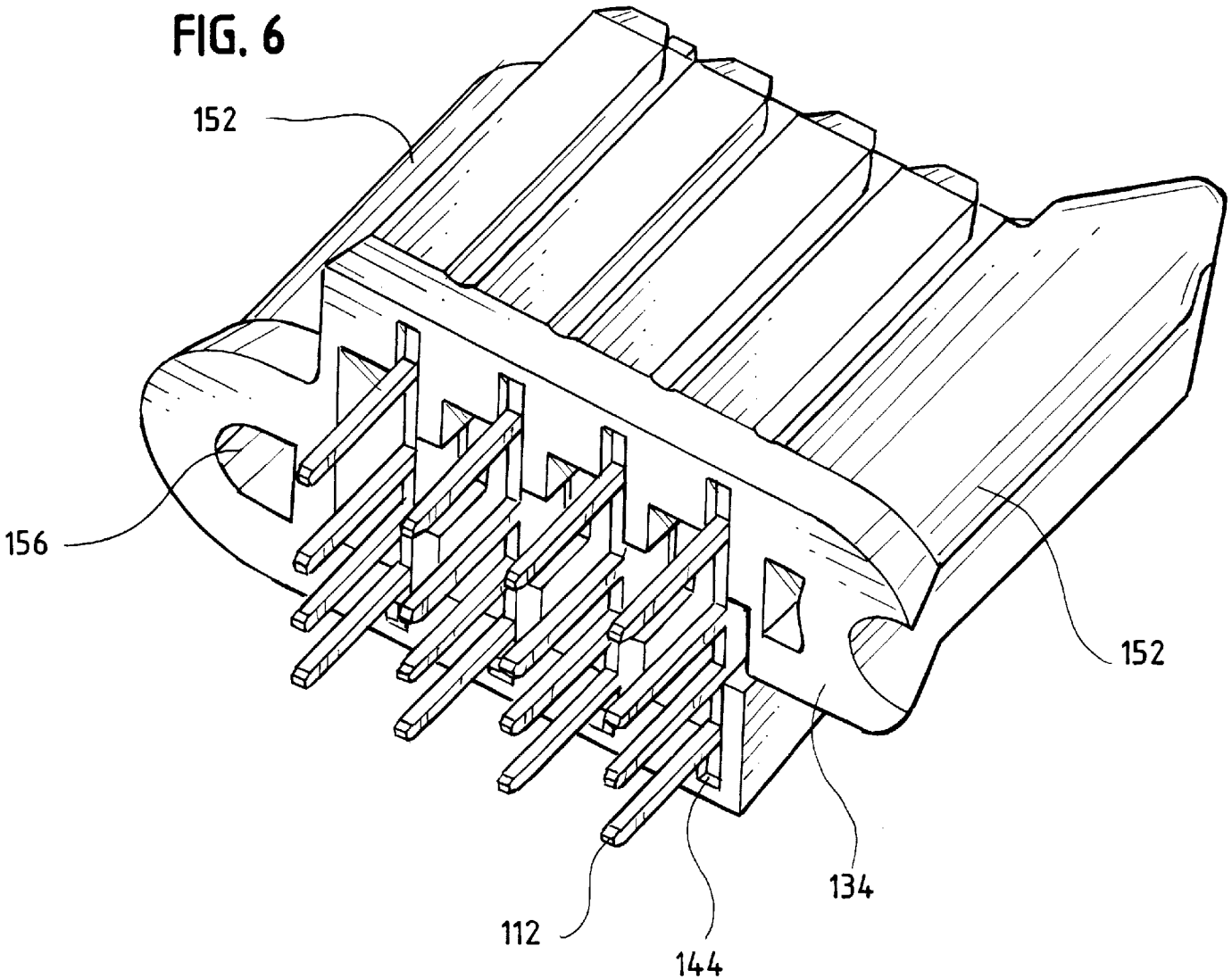
FIG. 6 illustrates a rear isometric view of a receptacle connector formed in accordance with at least one embodiment of the present invention.

As illustrated in FIG. 6, the rear face 134 of the receptacle housing 124 includes a plurality of slots 144 therein, through which contact tails 112 extend. The contact tails 112 are received in plated through holes 22 in the second support structure 18 and are secured thereto either through press fitting, soldering and the like.

Figure 8:
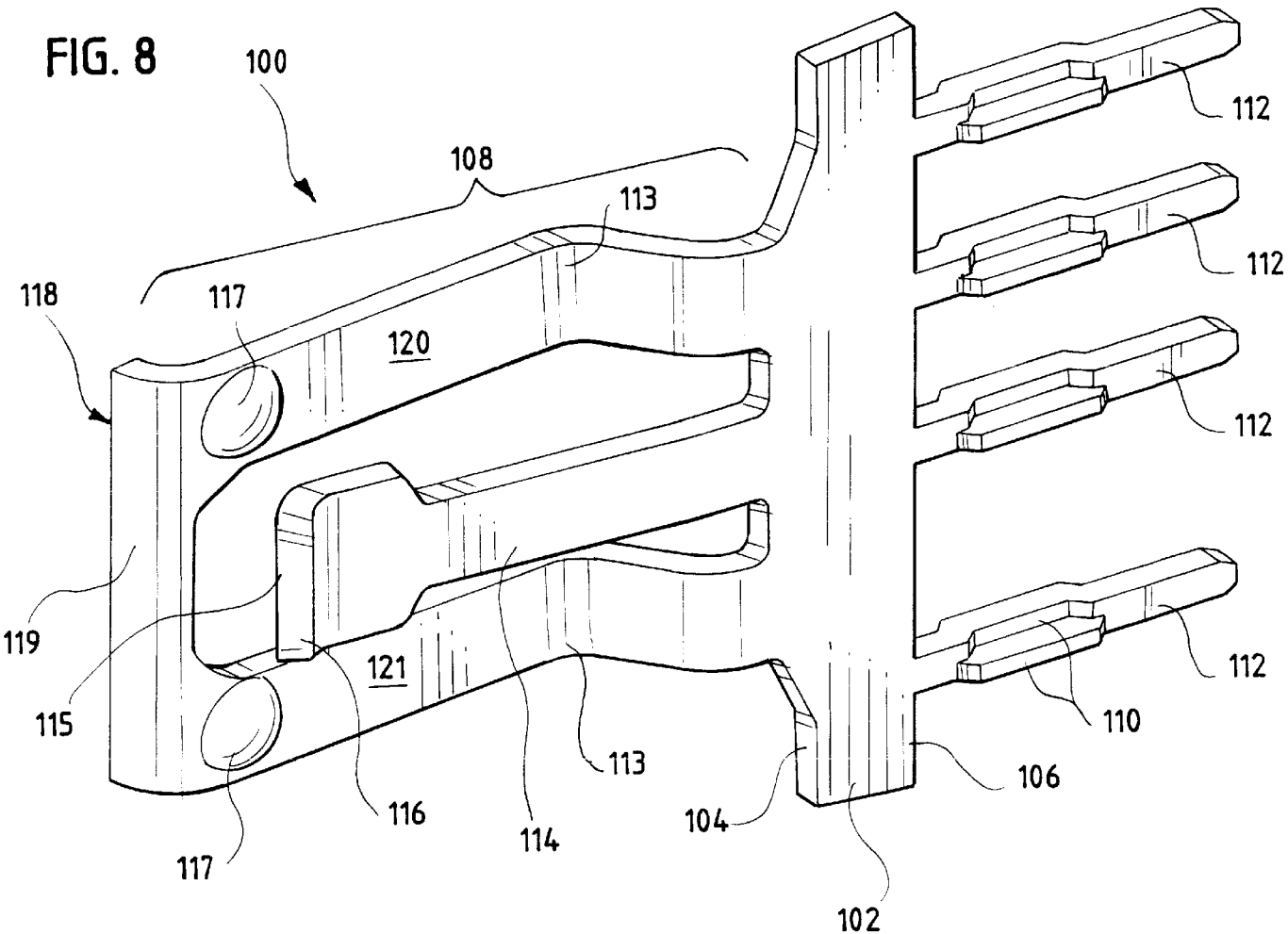
FIG. 8 illustrates an isometric view of a receptacle contact formed in accordance with at least one embodiment of the present invention.

As illustrated in FIG. 8, the receptacle contact 100 includes a central bar portion 102 having a leading edge 104 and a trailing edge 106. The tails 112 are formed with and extend rearward from the trailing edge 106. Optionally, the pins 112 may be compliant tails, such that each tail includes a central flared portion 110 extending in a direction transverse to the plane of the receptacle connector 100. The flared portions 110 afford a secure frictional fit into the plated through holes 22 in the second support structure 18.

The receptacle contact 100 also includes a contact assembly 108 extending forward from the leading edge 104. The contact assembly 108 may include a central cantilevered beam 114 having an outer flared end 116. The contact assembly 108 also includes a U-shaped contact beam 118 formed with first and second spring legs 120 and 121. Outer ends of the spring legs 120 and 121 are joined by a cross beam 119. Optionally, convex surfaces 117 may be formed on outer ends of the U-shaped contact arm 118. Optionally, convex surfaces may be formed on the flared end 116 of the cantilever beam 114. The convex surfaces 117 and the cantilever beam 114 maintain an electrical connection between the receptacle contact 100 and the contact 56 when the plug and receptacle connectors 12 and 14 are fully mated. The spring legs 120 and 121 include bent portions 113 to facilitate the biases of the U-shaped contact arm 118.

Figure 7:
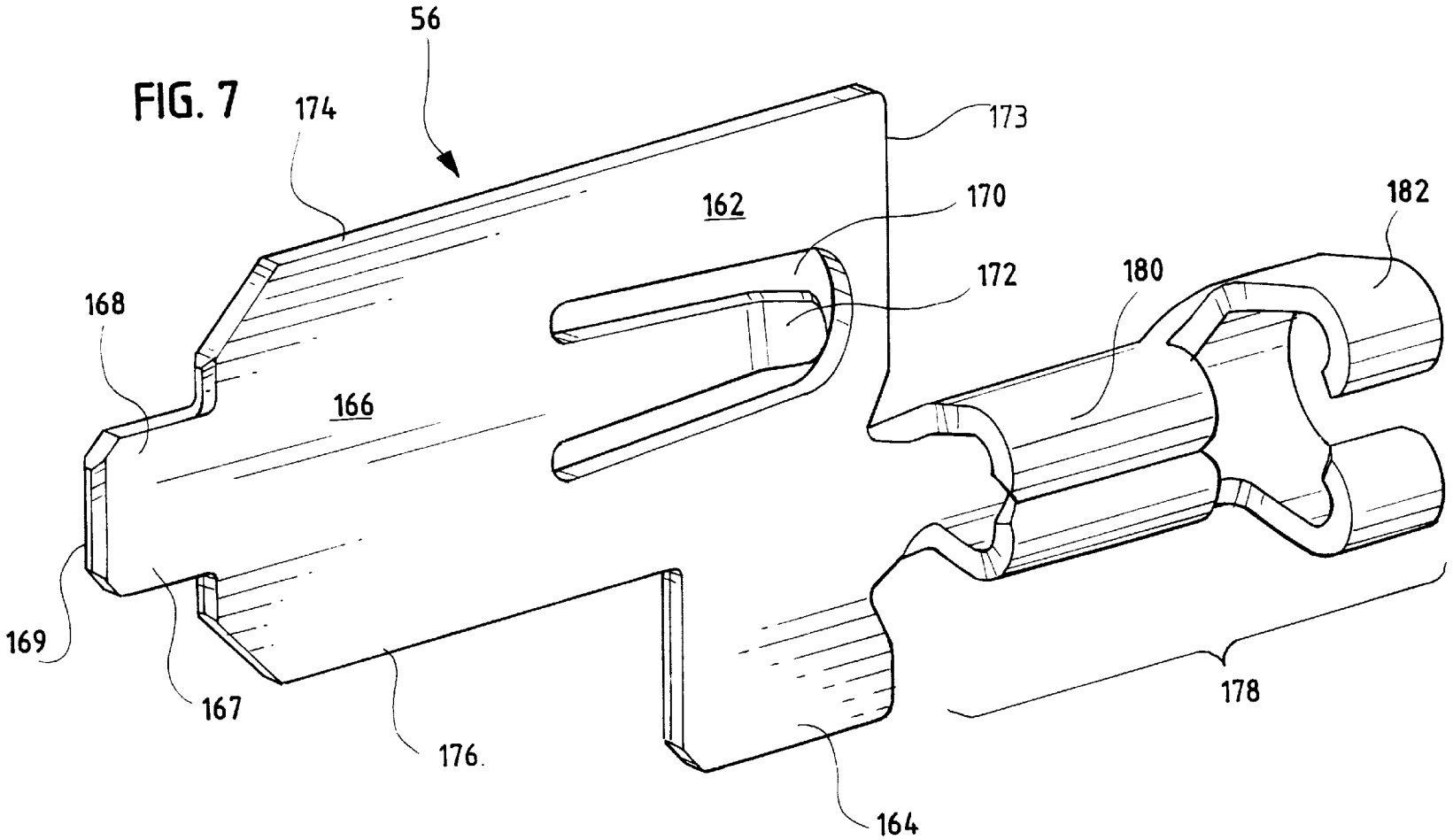
FIG. 7 illustrates an isometric view of a blade contact formed in accordance with at least one embodiment of the present invention.

FIG. 7 illustrates a contact 56 formed in accordance with one embodiment. The contact 56 fits into any of cavities 66 in the upper and lower rows 68 and 70. When in the upper rows 68, the contact 56 is oriented as shown in FIG. 7. When provided in the lower row 70, the orientation of the contact 56 is inverted 180°.

The convex surfaces or dimples 117 on the receptacle contact 100 increase the reliability of the interconnection between the receptacle contact 100 and the contacts 56 after a hot plugging sequence. A hot plugging sequence may be as follows. First, one of sides 167 and 169 on the nose piece 168 of the contact 56 will contact surface 119 on the receptacle contact 100. Next, the opposite of sides 167 and 169 will engage surface 115 on the beam 114 on the receptacle contact 100. Next, the first of sides 167 and 169 of the contact 56 will engage the dimples 117. The dimples 117 are located, in the example of FIG. 8, upon the spring legs 120 and 121. Hence, outer lateral portions of the knife section 166 would engage the dimples 117. The additional contact points offered by dimples 117 provide reliable contact points and avoid damage due to arcing since arcing occurs at the nose piece 168 during the hot plugging operation. Typically, hot plugging may damage the contacts 56 and 100 by melting the plating and base material on the contacts 56 and 100 to a certain degree.

The contact 56 includes a main body section 162 formed with a lower leg 164 and a knife section 166. The front end of the knife section 166 may include a nose piece 168. Edges of the nose piece 168 and knife section 166 may be beveled and chamfered, such as at a 45° angle, to facilitate connection. The main body section 162 includes a central cut-out 170 with a cantilevered beam 172 provided therein. The beam 172 securely engages a corresponding recess inside the plug housing 24 to retain the contact 56 in an engaged and secured position. The main body section 162 includes an upper edge 174 and a lower edge 176. When the contacts 56 are inserted into the lower row 70 of cavities 66, the contacts 56 are oriented with the upper edge 174 directed upward toward the top surface 28 of the plug housing 24, while the lower edge 176 is directed downward toward the bottom surface 32. The lower leg 164 is received in the lower row 70 of cavities 66.

The contacts 56 are inverted when provided in the upper row 68 of cavities 66. When inverted, the contacts 56 are oriented with the lower edge 176 directed upward toward the top surface 28 and with the upper edge 174 directed downward toward the bottom surface 32 of the plug housing 24. When in the inverted position, the lower leg 164 is received in the upper row of cavities.

The lower leg 164 includes a wire retention assembly 178 formed thereon and extending rearward therefrom. The wire retention assembly 178 extends backward from the rear edge 173 of the main body section 162. The wire retention assembly 178 includes at least one set of flared wire crimps 180. Optionally, the wire retention assembly 178 may also include a pair of flared insulation crimps 182. The contact 56 is secured to a wire (not shown) by providing a bare portion of the wire inside of the wire crimps 180 which are then clamped down onto the wire. The insulation crimps 182 may similarly be clamped onto the insulated portion of the wire to provide added support. The contact 56 provides a large flat section that offers significant heat dissipation characteristics. The contact 56 is formed with a symmetrical configuration such that a single contact design may be used in the cavities in both the upper and lower rows 68 and 70.

While the contact 56 is illustrated with a lower leg 164 projected down from the main body section 162, optionally, the main body section 162 may extend downward along the front portion of the lower leg 164 to provide an even larger contact surface. Optionally, the wire retention assembly 178 may be moved upward along the rear edge 173 or downward toward the bottom of the lower leg 164. Optionally, more than one wire retention assembly may be provided on the single contact. As a further alternative, the wire retention assemblies need not use wire crimps. Instead, the wire retention assemblies 178 may be soldered to corresponding wires.

While at least some of the embodiments discussed above concern a plug connector 12 that is floatable with a rigid receptacle connector 14, the present invention is not so limited. Instead, the receptacle connector may be provided with the floatable mounting assembly and movable vertically or laterally with respect to the attached support structure, while the plug contact may be directly, rigidly and securely mounted to the support structure. As a further alternative, both the plug and receptacle connectors may be provided with floating connections to provide even additional tolerance for misalignment. In one alternative embodiment, both the plug and receptacle would be movable laterally and vertically to correct for misalignment.

Figure 9:
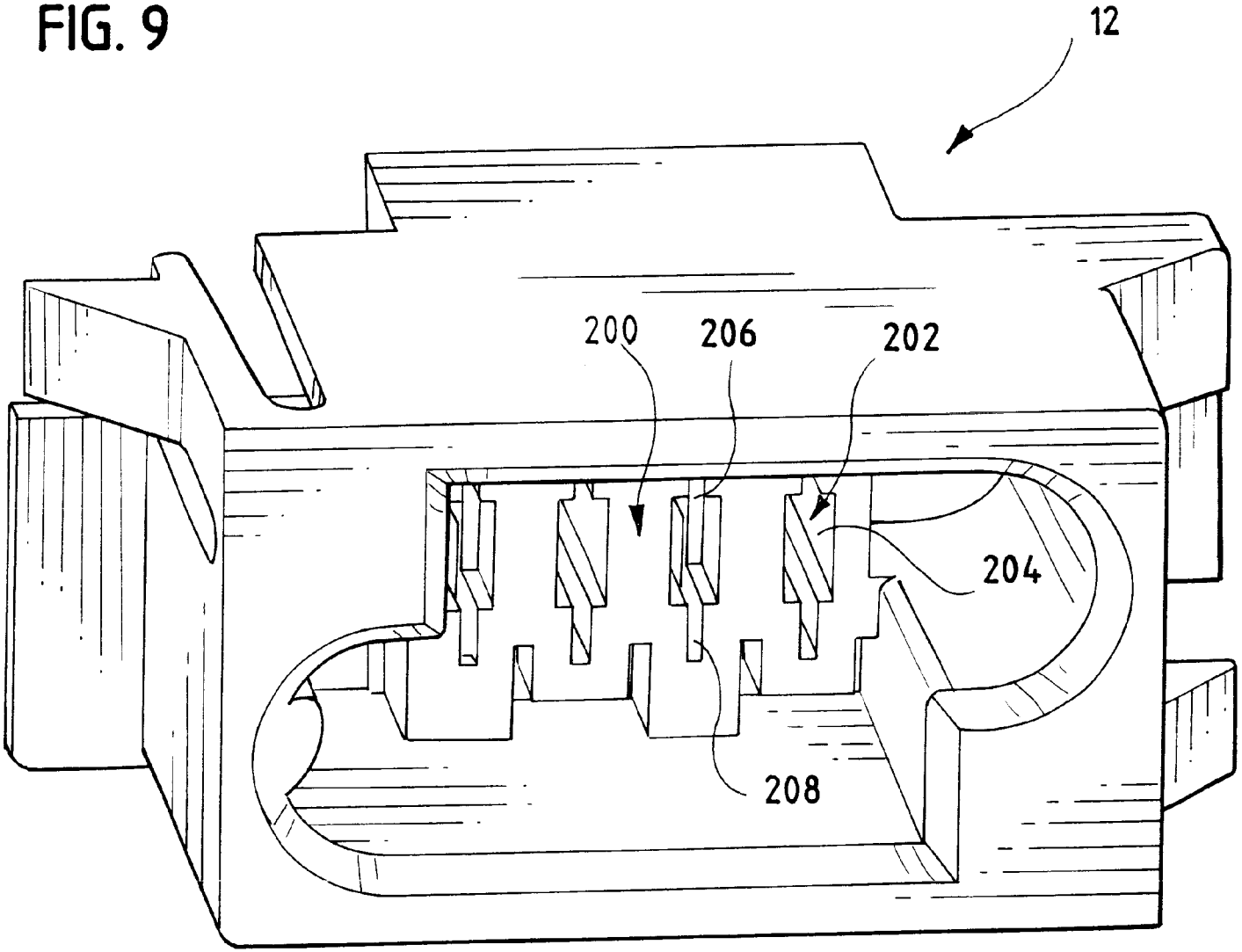
FIG. 9 illustrates an isometric view of a plug connector formed in accordance with at least one embodiment of the present invention.

FIG. 9 further illustrates the details of at least one embodiment of the plug connector 12. The chamber 54 includes an inner face 200 having a plurality of notches 202 formed therein. The notches 202 includes rectangular central body portions 204 with upper and lower slots 206 and 208, respectively communicating therewith. The upper and lower slots 206 and 208 securely receive the upper edge 174 and the lower leg 164 of contacts 56. As explained above, alternate contacts are inverted with respect to one another and thus, the upper slots 206 on alternate notches 202 receive the upper edges 174 of contacts 56. The upper slots 206 of the intervening notches 202 receive the lower legs 164 of the inverted contacts 56.

The notches 202 communicate with the cavities 66 (FIG. 4).

Optionally, the number of cavities and the configuration of cavities may differ from the illustration of FIG. 4. For example, only two cavities may be provided, one in the upper row and one in the lower row. Alternatively, more than two cavities may be provided in each of the upper and lower rows. As a further alternative, more than two rows of connectors may be provided. For example, if a third row of connectors is provided below the lower row 70, the third row of cavities would be oriented with the notches extending upward toward notches 83. Hence, the notches of the third row may extend into insulated cavity spaces 73 and be located below the notches 83. Any number of additional rows and columns of cavities may be provided.

Optionally, the cavities 66 may be aligned in a direction other than vertically. For instance, the cavities may be oriented horizontally or diagonally or in a circular pattern. When oriented in a horizontal pattern, the cavities would be rotated 90 degrees and the notches 82 and 83 would be aligned horizontally to form columns of cavities 66 offset or staggered (vertically) with respect to one another. Similarly, the contacts 56 would be rotated 90 degrees to lay in planes substantially parallel to the plane formed by the longitudinal and lateral axes 74 and 76, respectively.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. A connector assembly floatably mounted to a mounting structure, comprising:

a mounting structure having a connector opening therein, said connector opening having an inner perimeter;

a connector housing having peripheral surfaces with an outer contour shape to fit loosely in said inner perimeter of said mounting structure to form a float gap between said inner perimeter of said opening and said connector housing, said connector housing slidably inserting into said opening in said mounting structure; and at least one latch beam provided with said connector housing, said latch beam having a tab finger engaging said inner perimeter of said opening when said connector housing is floatably secured in said opening in said mounting structure.

2. The connector assembly of claim 1, further comprising a pair of latch beams arranged on opposite sides of said connector housing, said pair of latch beams having tab fingers securely engaging opposite sides of said inner perimeter when said connector housing is fully loaded into said opening.

3. The connector assembly of claim 1, wherein said connector housing includes a mating face arranged in a mating plane, a float gap located between said inner perimeter of said opening and said outer contour of said connector housing enabling movement of said connector housing in at least one direction transverse to said mating plane to permit movement of said connector housing until properly aligned with a mating connector housing.

4. The connector assembly of claim 1, wherein said connector housing includes a backside having at least one flange laterally extending outward from one of said peripheral surfaces, said flange engaging one side of said mounting structure, said latch beam engaging an opposite side of said mounting structure, said flange and latch beam retaining said connector housing within said mounting structure.

5. The connector assembly of claim 1, wherein said at least one latch beam comprises a pair of latch beams formed integral with opposed sides of said connector housing, said latch beams being arranged diagonally across from one another to provide substantially balanced latching forces during a connector latching operation.

6. The connector assembly of claim 1, further comprising a pair of guide pins formed integral with opposed sides of said connector housing, said guide pins being arranged diagonally across from one another to provide substantially balanced mating forces during a connector latching operation.

7. The connector assembly of claim 1, wherein said connector housing further comprises: a mating face adapted to be joined with a mating connector, a contact retaining cavity having an open side in said mating face, said cavity including guide pockets arranged offset from, and diagonally opposed to, one another.

8. The connector assembly according to claim 1 wherein said latch beam includes a projection formed thereon adjacent said tab finger, said projection being pushed through said opening.

9. A connector system, comprising:

a first connector housing having a first mating face, sidewalls defining a first outer perimeter, and a first cavity to retain at least one contact;

a second connector housing having a second mating face, sidewalls defining a second outer perimeter, and a second cavity to retain at least one contact;

a first mounting structure including a connector opening, said connector opening having an inner perimeter, said connector opening accepting said first connector housing;

a gap provided between said inner perimeter of said connector opening and said first outer perimeter of said first connector housing, said gap permitting lateral movement between said first connector housing and said first mounting structure; and a latch assembly provided with said first connector housing, said latch assembly having a tab finger engaging said inner perimeter of said connector opening when said first connector housing is floatably secured in said connector opening in said mounting structure.

10. The connector assembly of claim 9, wherein said latch assembly includes latch beams formed integral with said sidewalls and projecting outward from said sidewalls.

11. The connector assembly of claim 9, wherein said latch assembly further comprises a pair of latch beams arranged on opposite diagonal corners of said first connector housing.

12. The connector system of claim 9, further comprising a second mounting structure rigidly secured to a rear face of said second connector housing to prevent lateral movement of therebetween.

13. The connector system of claim 9, wherein said first connector housing constitutes a plug connector, and said second connector housing constitutes a receptacle connector.

14. The connector system of claim 9, wherein said first connector housing constitutes a receptacle connector, and said second connector housing constitutes a plug connector.

15. The connector system of claim 9, further comprising a second mounting structure retaining said second connector housing, and wherein said gap and latch assembly permit movement of said first connector housing in directions lateral to said first mating face to permit connection of said first and second connector housings even when said first and second mounting structures are misaligned.

16. The connector assembly according to claim 9 wherein said latch beam includes a projection formed thereon adjacent said tab finger, said projection being pushed through said connector opening.

17. The connector assembly of claim 9, further comprising a pair of latch beams arranged on opposite sides of said connector housing, said pair of latch beams having tab fingers securely engaging opposite sides of said inner perimeter when said connector housing is fully loaded into said connector opening.

* * * * *